United States Patent [19]

Otobe

[11] Patent Number: 4,688,533

[45] Date of Patent: Aug. 25, 1987

[54] OPERATION CONTROL SYSTEM FOR AN INTERNAL COMBUSTION ENGINE WITH A THROTTLE VALVE FINELY ADJUSTABLE IN VALVE OPENING AT LOW LOAD OPERATION OF THE ENGINE

[75] Inventor: Yutaka Otobe, Shiki, Japan

[73] Assignee: Honda Giken Kogyo K.K., Tokyo, Japan

[21] Appl. No.: 910,336

[22] Filed: Sep. 19, 1986

Related U.S. Application Data

[63] Continuation of Ser. No. 736,787, May 22, 1985, abandoned.

[30] Foreign Application Priority Data

May 29, 1984 [JP] Japan ..... 59-109255

[51] Int. Cl.[4] ..... F02D 9/08; F02D 3/00

[52] U.S. Cl. ..... 123/337; 123/336; 123/478; 123/342

[58] Field of Search ..... 123/336, 337, 342, 361, 123/376, 403, 478

[56] References Cited

U.S. PATENT DOCUMENTS

| | | | |
|---|---|---|---|
| 998,355 | 7/1911 | Lee | 123/337 |
| 3,675,731 | 7/1972 | Stopora | 123/337 |
| 3,791,366 | 2/1974 | MacMillan | 123/337 |
| 4,002,085 | 1/1977 | Johnston | 123/337 |
| 4,116,185 | 9/1978 | Mayor et al. | 123/337 |
| 4,257,374 | 3/1981 | Matrumoto et al. | 123/337 |
| 4,475,503 | 10/1984 | Nakamura et al. | 123/361 |
| 4,524,740 | 6/1985 | Brockhaus | 123/342 |

FOREIGN PATENT DOCUMENTS

| | | | |
|---|---|---|---|
| 50-77059 | 6/1975 | Japan | 123/478 |
| 52-18526 | 2/1977 | Japan | 123/478 |

*Primary Examiner*—Raymond A. Nelli
*Attorney, Agent, or Firm*—Arthur L. Lessler

[57] ABSTRACT

An operation control system for an internal combustion engine includes a mechanically connecting device connecting between an accelerator pedal and a throttle valve and operable such that an amount of change in the valve opening of the throttle valve relative to a change in the stepping amount of the accelerator pedal is smaller in a smaller stepping amount region than in a larger stepping amount region. A throttle valve opening sensor is adapted to generate as actual throttle valve opening an output signal directly proportional in valve to a stepping amount of the accelerator pedal. A control unit is responsive to the output signal from the throttle valve opening sensor for controlling an operating amount of the operation control system. The system thus permits fine adjustment of the intake air quantity supplied to the engine in a low load region and can accurately sense the throttle valve opening during operation of the engine in the low load region, to thereby achieve improved driveability of the engine at acceleration, etc.

7 Claims, 6 Drawing Figures

OPERATION CONTROL SYSTEM FOR AN INTERNAL COMBUSTION ENGINE WITH A THROTTLE VALVE FINELY ADJUSTABLE IN VALVE OPENING AT LOW LOAD OPERATION OF THE ENGINE

This application is a continuation, of application Ser. No. 06/736,787, filed May 22, 1985, now abandoned.

BACKGROUND OF THE INVENTION

This invention relates to operation control systems for internal combustion engines having throttle valves.

If an operating mechanism for operating a throttle valve arranged in the intake system of an internal combustion engine is constructed to vary the valve opening of the throttle valve linearly in proportion to an amount of stepping on the accelerator pedal, even a slight change in the stepping amount of the accelerator pedal will cause an abrupt change in the quantity of intake air supplied to the engine when the engine is operating in a low load region, often spoiling the driveability of the engine. This is conspicuous particularly in a so-called multi-throttle engine in which a plurality of throttle valves are arranged in respective intake passages (branch passages) of the intake manifold which are connected to respective cylinders so as to vary the quantities of intake air supplied to the respective cylinders in quick response to changes in the throttle valve openings for improved driveability of the engine at sudden acceleration or at sudden deceleration. However, since the throttle valves are thus located closer to respective intake valves than in an ordinary type engine, the passage volume of a portion of the intake passage extending between each throttle valve and the associated intake valve is smaller than that in the ordinary type engine. As a consequence, even a slight change in the valve opening of the throttle valve will cause a large change in the intake air quantity supplied to the engine, which makes the intake air quantity change the more conspicuous in response to a change in the stepping amount of the accelerator pedal.

FIG. 1 shows changes in the throttle valve opening $\theta$TH and the intake air quantity Qa which are plotted with respect to the stepping amount $\theta$ACC of the accelerator pedal. It will be learned from the graph that if the throttle valve opening $\theta$TH is varied along a straight solid line a, i.e. in direct proportion to the accelerator pedal stepping amount $\theta$ACC, the resulting intake air quantity Qa varies along a solid line A, that is, the rate of change in the intake air quantity is larger when the accelerator pedal is in a smaller stepping-amount region L, i.e. when the engine is in a low load region.

To eliminate the aforementioned disadvantage, it is therefore desirable that in the low load region L of the engine the intake air quantity Qa should vary linearly (along a straight dotted line B in FIG. 1) in direct proportion to the accelerator pedal stepping amount $\theta$ACC. To this end, the throttle valve operating mechanism should be designed so as to reduce the rate of change in the throttle valve opening $\theta$TH with respect to the change of the accelerator pedal stepping amount $\theta$ACC in the low load region L of the engine. However, conventionally a throttle valve opening sensor as a component of an engine operation control system such as an electronic fuel supply control system is mounted on the valve stem of the throttle valve to sense the throttle valve opening $\theta$TH. If the sensor is used together with the throttle valve operating mechanism designed to reduce the rate of change in the throttle valve opening in the low load region L, there will be a time delay in detecting sudden acceleration of the engine from an idling region due to the reduced rate of change in the throttle valve opening in the low load region L, resulting in degraded driveability of the engine.

SUMMARY OF THE INVENTION

It is the object of the invention to provide an operation control system for an internal combustion engine, which permits fine adjustment of the intake air quantity supplied to the engine in a low load region and is capable of accurately sensing the throttle valve opening during operation of the engine in the low load region, to thereby achieve improved driveability of the engine at acceleration, etc.

The present invention provides an operation control system for an internal combustion engine having an intake system, a throttle valve arranged in the intake system, and an accelerator pedal for adjusting the valve opening of the throttle valve.

The operation control system according to the invention is characterized by comprising in combination: a throttle valve opening sensor adapted to generate as actual throttle valve opening an output signal directly proportional in value to a stepping amount of the accelerator pedal; mechanically connecting means operatively connecting between the accelerator pedal and the throttle valve; and control means responsive to the output signal from the throttle valve opening sensor for controlling an operating amount of the operation control system. The above mechanically connecting means is operable such that an amount of change in the valve opening of the throttle valve relative to a change in the stepping amount of the accelerator pedal is smaller when the accelerator pedal is in a smaller stepping amount region than when the accelerator pedal is in a larger stepping amount region.

The above and other objects, features and advantages of the invention will be more apparent from the ensuing detailed description taken in conjunction with the accompanying drawings.

DETAILED DESCRIPTION

The invention will now be described in detail with reference to the drawings showing an embodiment thereof.

Figure 2:
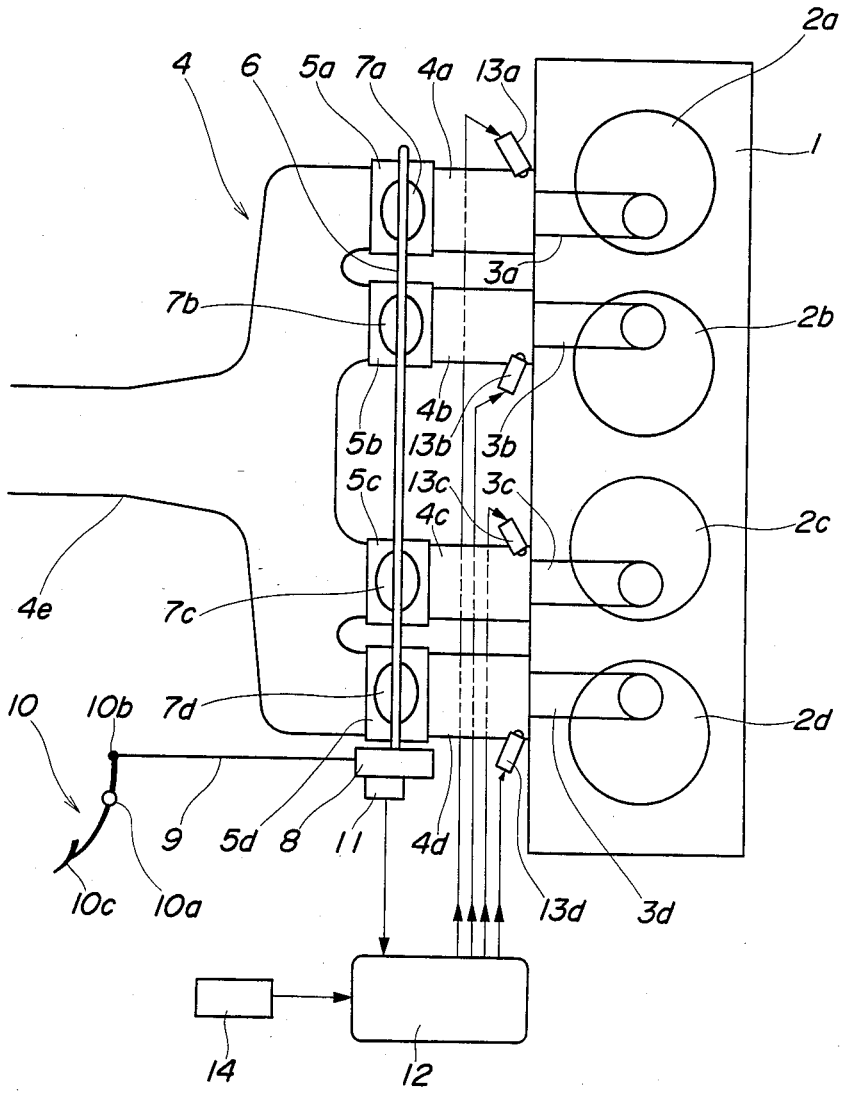
FIG. 2 is a schematic view showing the arrangement of a fuel supply control system to which is applied the present invention.

Referring first to FIG. 2, there is illustrated the arrangement of a fuel supply control system for an internal combustion engine to which is applied the invention. Reference numeral 1 designates a multi cylinder internal combustion engine having four cylinders 2a–2d, for instance. Connected to respective intake ports 3a–3d of the cylinders 2a–2d are one ends of intake passages (branch passages) 4a–4d of an intake manifold 4 which are joined at the other ends to a distributing passage 4e of the intake manifold 4. An end of the distributing passage 4e remote from the engine cylinders is communicated with the atmosphere via an air cleaner, not shown.

Arranged across the intake passages 4a–4d are throttle bodies 5a–5d which are transversely penetrated by a single throttle valve stem 6 rotatably supported by the throttle bodies. Four throttle valve bodies (hereinafter merely called "throttle valves") 7a–7d are accommodated within the respective throttle bodies 5a–5d and secured on the valve stem 6 for concurrent rotation in unison with the rotating valve stem 6 to supply the respective cylinders 2a–2d with equal amounts of intake air. Connected to one end of the throttle valve stem 6 is a mechanically connecting device 8, hereinafter described, which is operatively connected to an accelerator pedal 10 by means of a wire 9. The accelerator pedal 10 is pivotable about a pivot 10a and secured at one end to the wire 9. The effective length of the accelerator pedal 10 and the location of the pivot 10a on the accelerator pedal 10 are set such that the ratio of the displacement of the one end 10b of the accelerator pedal 10 to the displacement of the other end 10c, i.e. the stepping amount $\theta$ACC of the accelerator pedal 10 assumes a predetermined fixed value, e.g. $\frac{1}{2}$. The circumferential position of the throttle valve stem 6, i.e. the valve opening $\theta$TH of the throttle valves 7a–7d is determined by the stepping amount $\theta$ACC of the accelerator pedal 10.

A throttle valve opening sensor 11 is mounted on the mechanically connecting device 8 to sense the valve opening $\theta$TH of the throttle valves 7a–7d and supply an output signal indicative of the sensed throttle valve opening $\theta$TH to an electronic control unit (hereinafter called "the ECU") 12.

Fuel injection valves 13a–13d are arranged in the respective intake passages 4a–4d in the vicinity of the respective intake ports 3a–3d, and are electrically connected to the ECU 12. Further connected to the ECU 12 are other parameter sensors 14 for sensing other engine controlling parameters such as engine rotational speed, intake air quantity, and engine coolant temperature, to supply respective output signals indicative of the sensed parameter values to the ECU 12.

The ECU 12 determines the fuel injection quantity on the basis of the output signals from the throttle valve opening sensor 11 as well as from the other parameter sensors 14. To be specific, the ECU 12 determines from the output signal from the throttle valve opening sensor 11 whether or not the engine is operating in an accelerating condition. This determination may be made by determining whether or not a rate of change $\Delta\theta$TH in the value $\theta$TH of the output signal from the throttle valve opening sensor 11 is larger than a predetermined value $\Delta$G. When the rate of change $\Delta\theta$TH is determined to be larger than the predetermined value $\Delta$G, the ECU 12 judges that the engine is in a predetermined sudden accelerating condition, then calculates the sum of a basic fuel quantity value determined on the basis of output signals from the other parameter sensors 14 and an accelerating fuel increment corresponding to the rate of change $\Delta\theta$TH, and supplies valve opening commands corresponding to the calculated sum to the fuel injection valves 13a–13d which in turn are opened by the commands to supply required amounts of fuel into the respective cylinders 2a–2d.

Figure 3:
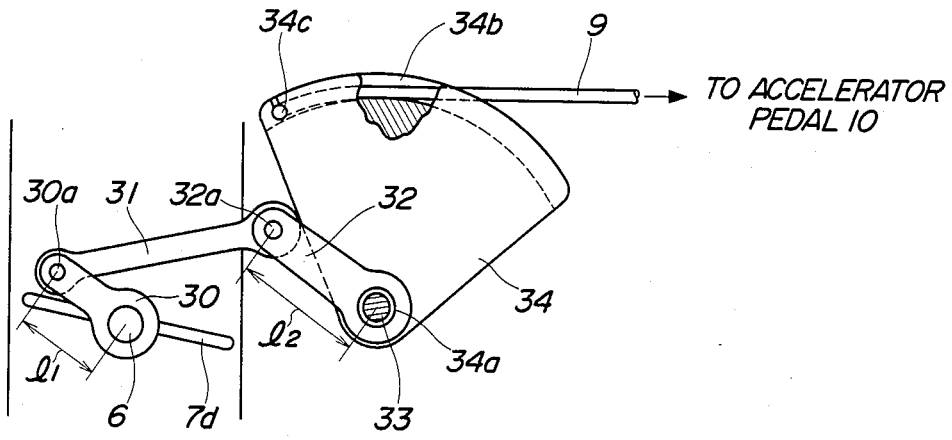
FIG. 3 is a view showing in detail an example of a mechanically connecting device in FIG. 2.
Figure 4:
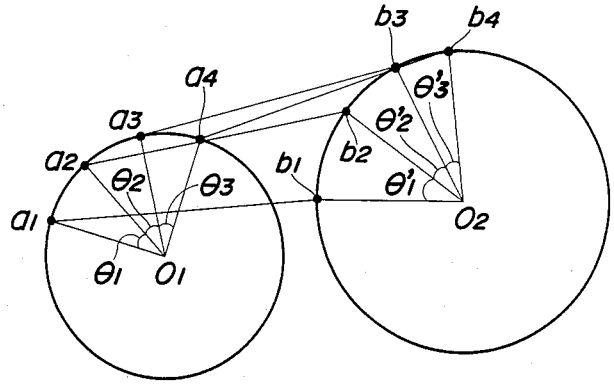
FIG. 4 is a view showing pivotal displacement of a lever 32 in FIG. 3 caused by pivotal displacement of a lever 30 in the figure.

FIG. 3 shows the interior construction of the mechanically connecting device 8 in FIG. 2. A lever 30 having an effective length $l_1$ is secured to one end of the throttle valve stem 6 in FIG. 2. A fulcrum shaft 33 is disposed parallel with the throttle valve stem 6 and rotatably supported by the throttle bodies 5d, and to which is secured one end of a lever 32 which is located on the same plane as a plane perpendicular to the axis of the throttle valve stem 6 on which the lever 30 is located, and has an effective length $l_2$ larger than the effective length $l_1$ of the lever 30. The levers 30 and 32 are connected with each other by means of a rod 31 pivoted at opposite ends to associated ends 30a and 32a of the levers 30, 32. FIG. 4 shows orbital paths of the ends 30a, 32a of the levers 30, 32 of a link motion constituted by the levers 30, 32 and the rod 31. Provided that a point $a_1$ on the perimeter of a circle with the axis $O_1$ of the throttle valve stem 6 as its center and having a radius $l_1$ (located within the second quadrant in the figure) corresponds to the fully closed positions of the throttle valves 7a–7d, a position $b_1$ of the end 32a of the lever 32 corresponding to the point $a_1$ is located in the vicinity of an intersecting point at which the perimeter of a circle with the axis $O_2$ of the fulcrum shaft 33 as its center and having a radius $l_2$ intersects with a horizontal straight line extending from the axis $O_2$ toward the point $a_1$.

Figure 5:
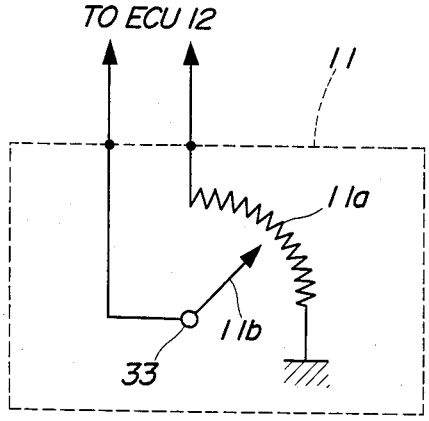
FIG. 5 is a schematic view showing, by way of example, the interior construction of a throttle valve opening sensor in FIG. 2.

A sectorial member 34 is secured at its base 34a to the fulcrum shaft 33. The sectorial member 34 has an arcuate peripheral surface formed with a longitudinally extending arcuate groove 34b and is acted upon in the counterclockwise direction as viewed in FIG. 3 by a spring, not shown. The wire 9 in FIG. 2 is longitudinally fitted in the groove 34b and secured at one end to the sectorial member 34 at one end of the groove 34b remote from the accelerator pedal 10. The throttle valve opening sensor 11 in FIG. 2 is mounted on the fulcrum shaft 33. The throttle valve opening sensor 11 may preferably be formed by a known type potentiometer as shown in FIG. 5 wherein it comprises a resistor 11a, and a slider 11b pivotable about the rotating fulcrum shaft 33 to slide on the resistor 11a in unison with the fulcrum shaft 33.

When the accelerator pedal 10 in FIG. 2 is stepped on, the sectorial member 34 is pulled by the wire 9 to be pivotally displaced about the base 34a through an angle corresponding to the stepping amount $\theta$ACC of the accelerator pedal 10. The pivotal displacement of the sectorial member 34 in turn causes concurrent rotation of the throttle valves 7a–7d secured on the throttle valve stem 6 through the link motion formed by the levers 30, 32 and the rod 31. The relationship between the amount of pivotal displacement of the lever 30 and that of the lever 32 will now be explained with reference to FIG. 4. Let it be assumed that with an increase in the stepping amount of the accelerator pedal 10, the end 30a of the lever 30, which is a driven member, is pivotally displaced in the clockwise direction as viewed in FIG. 4 from the point $a_1$ corresponding to the fully closed positions of the throttle valves 7a–7d to successively pass through points $a_2$, $a_3$, and $a_4$, the angles $\theta_1$, $\theta_2$, and $\theta_3$ between the adjacent points $a_1$, $a_2$, $a_3$, and $a_4$ being equal to each other. As the lever end 30*a* is pivotally displaced from the point $a_1$ to the point $a_4$, the lever end 32*a* is accordingly pivotally displaced from a point $b_1$ to a point $b_4$, wherein the distance between the points $a_1$ and $b_1$, between the points $a_2$ and $b_2$, between the points $a_3$ and $b_3$, and between the points $a_4$ and $b_4$ is equal to the distance between fulcrums of the opposite ends of the rod 31. As clearly shown in FIG. 4, the angles $\theta'_1$, $\theta'_2$, and $\theta'_3$ of pivotal displacement of the lever end 32*a* corresponding, respectively, to ones $\theta_1$, $\theta_2$, and $\theta_3$ of the lever end 30*a* become smaller in the order mentioned (i.e. $\theta'_1 > \theta'_2 > \theta'_3$). This means that the angle of pivotal displacement of the lever 32, i.e. the amount of change in the throttle valve opening $\theta$TH relative to the stepping amount $\theta$ACC, obtained when the accelerator pedal 10 is in a small stepping amount region, i.e. when the engine is in a low load region, is smaller than one obtained when the accelerator pedal is in a large stepping amount region, i.e. when the engine is in a high load region. By virtue of the link motion formed by the levers 30, 32 and the rod 31, the relationship between the throttle valve opening $\theta$TH and the accelerator pedal stepping amount $\theta$ACC can be similar to one represented by the dotted line b in FIG. 1.

Figure 1:
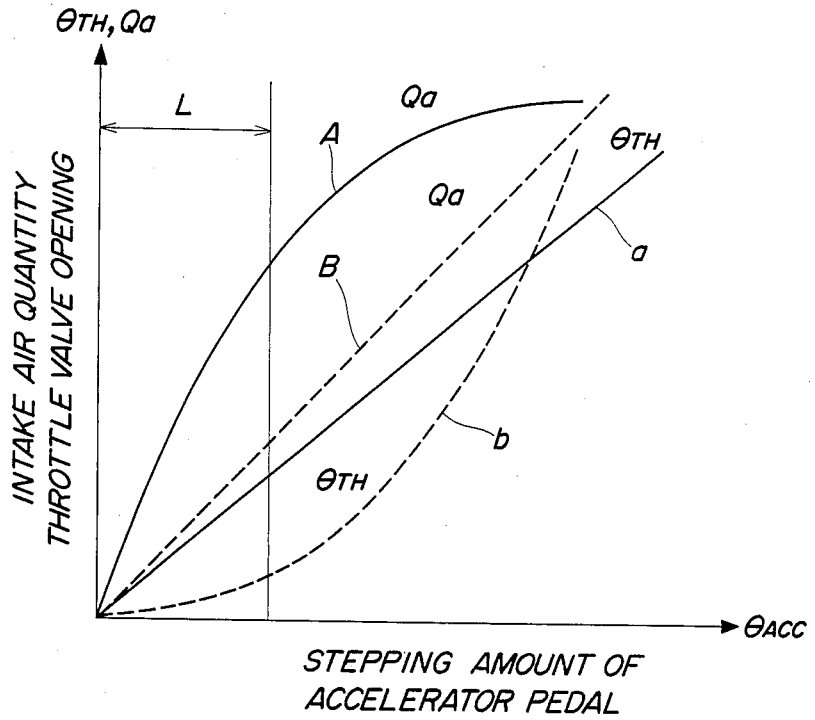
FIG. 1 is a graph showing, by way of example, changes in the intake air quantity Qa and throttle valve opening $\theta$TH plotted with respect to accelerator pedal stepping amount $\theta$ACC.

On the other hand, the throttle valve opening sensor 11 mounted on the fulcrum shaft 33 generates a signal variable in value in direct proportion to a change in the circumferential position of the fulcrum shaft 33, i.e. the accelerator pedal stepping amount $\theta$ACC, substantially along the dotted line a in FIG. 1, and supplies the signal to the ECU 12.

Figure 6:
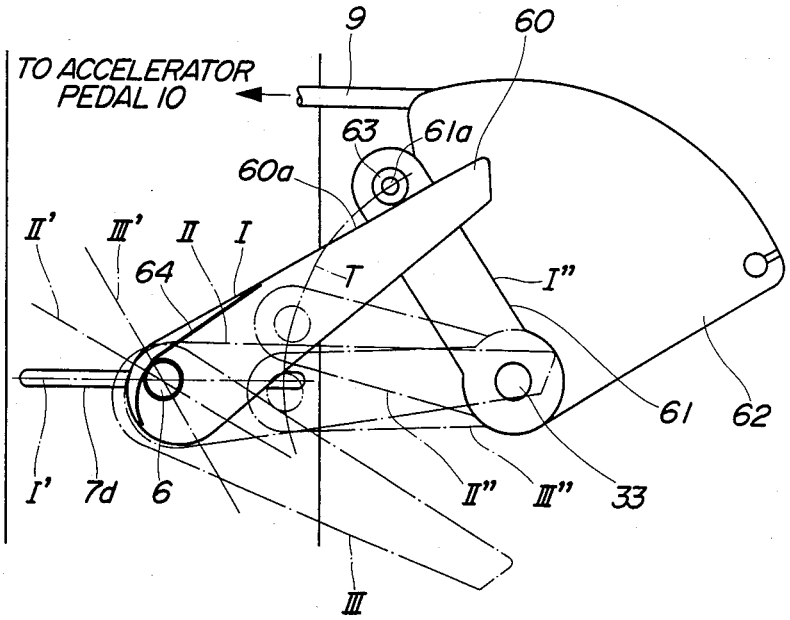
FIG. 6 is a view showing another example of the mechanically connecting device in FIG. 2.

FIG. 6 shows another example of the mechanically connecting device 8 which satisfies the relationship between the throttle valve opening $\theta$TH and the accelerator pedal stepping amount $\theta$ACC, represented by the dotted line b in FIG. 1. In FIG. 6, some parts and elements have the same functions with those designated by identical characters in FIGS. 2–5. A lever 60 is secured on one end of the throttle valve stem 6 in FIG. 2 and disposed to be directed rightwardly upward as viewed in FIG. 6 when the throttle valves 7*a*–7*d* assume fully closed positions. The lever 60 is permanently acted upon by a spring 64 in the counterclockwise direction as viewed in FIG. 6. Secured on the fulcrum shaft 33 parallel with the throttle valve stem 6 are a lever 61 located on a plane perpendicular to the axis of the fulcrum shaft 33 and substantially the same with the plane on which is located the lever 60, and disposed to be directed slightly leftwardly upward as viewed in FIG. 6 when the accelerator pedal is not stepped on, i.e. when the throttle valves 7*a*–7*d* assume fully closed positions, and a sectorial member 62 similar in shape to the sectorial member 34 in FIG. 3. A roller 63 is mounted on a free end 61*a* of the lever 61 and projected toward the lever 61 in urging contact with an upper lateral side surface 60*a* of the lever 60 so that it rolls over the upper lateral side surface 60*a* of the lever 60 to downwardly force the lever 60 as the lever 61 is pivotally displaced in the counterclockwise direction. A wire 9 is tied to the sectorial member 62 to pull same and accordingly cause the lever 61 to rotate in the counterclockwise direction when the accelerator pedal 10 in FIG. 2 is stepped on.

The end 61*a* of the lever 61 makes a circle T with the axis of the fulcrum shaft 33 as its center and having a radius thereof determined by the effective length of the lever 61, as the throttle valves 7*a*–7*d* rotate. The lever 61 is disposed to have its end 61*a* located in the vicinity of an uppermost portion of the perimeter of the circle T when the throttle valves 7*a*–7*d* assume their fully closed positions. Therefore, when the lever end 61*a* is located in the vicinity of the uppermost portion of the circle perimeter, that is, when the accelerator pedal 10 is in a small stepping amount region, the amount of vertical displacement of the lever end 61*a* as viewed in FIG. 6 relative to the stepping amount of the accelerator pedal 10 is smaller than one obtained when the accelerator pedal is in a large stepping amount region, though the angle of pivotal displacement of the lever 61 is the same. For example, as the lever 60 is pivotally displaced from a position corresponding to the fully closed positions of the throttle valves, depicted by the solid lines I, to positions II and III depicted by the imaginary or chain lines, the throttle valves 7*a*–7*d* are pivotally displaced from a position I′ depicted by the solid lines to positions II′ and III′ depicted by the imaginary lines, respectively, that is, through equal angles between the adjacent positions, whereas the lever 61 is pivotally displaced from a position I″ depicted by the solid lines to positions II″ and III″ depicted by the imaginary lines, respectively, that is, through gradually diminishing angles between the adjacent positions. In this way, the amount of change in the throttle valve opening $\theta$TH relative to a change in the accelerator pedal stepping amount is smaller in the small stepping amount region than in the large stepping amount region.

The mechanically connecting device 8 in FIG. 2 is not limited to those illustrated in FIGS. 3 and 6, but may be embodied in various forms insofar as it realizes a relationship between the accelerator pedal stepping amount and the throttle valve opening similar to one represented by the dotted line b in FIG. 1.

Although in the illustrated embodiment the throttle valve opening sensor 11 is mounted on the fulcrum shaft 33, it may alternatively be mounted on other parts insofar as it can provide a throttle valve opening signal directly proportional in value to the stepping amount of the accelerator pedal 11. For instance, it may be mounted on the accelerator pedal per se.

Also, the invention is applicable not only to multi-throttle engines as in the illustrated embodiment but also to ordinary type engines.

Furthermore, the operation control system according to the invention may not only be embodied as a fuel supply control system as in the illustrated embodiment but also as other kinds of control systems employing the throttle valve opening as an engine controlling parameter, such as an ignition timing control system and an exhaust gas recirculation control system.

What is claimed is:

1. An operation control system for an internal combustion engine having an intake system, a throttle valve arranged in said intake system, and an accelerator pedal for adjusting the valve opening of said throttle valve, said operation control system comprising in combination:

a throttle valve opening sensor adapted to generate as actual throttle valve opening an output signal directly proportional in value to a stepping amount of said accelerator pedal;

mechanically connecting means operatively connecting between said accelerator pedal and said throttle valve for moving said throttle valve in response to stepping-on of said accelerator pedal in a manner such that the ratio of movement between said accelerator pedal and said throttle valve is not directly proportional within a valve opening range of said throttle valve excluding a fully closed position thereof, said mechanically connecting means being operable to change the valve opening of said throttle valve, in response to a change in the stepping amount of said accelerator pedal in a manner such that an amount of change in the valve opening of said throttle valve relative to a change in the stepping amount of said accelerator pedal is smaller when said accelerator pedal is in a smaller stepping amount region than when said accelerator pedal is in a larger stepping amount region; and control means responsive to said output signal from said throttle valve opening sensor for controlling an operating amount of said operation control system.

2. An operation control system as claimed in claim 1, wherein said internal combustion engine has a plurality of cylinders, said intake system having a plurality of intake passages connected to respective ones of said cylinders, said throttle valve comprising a plurality of throttle valves arranged in respective ones of said intake passages.

3. An operation control system as claimed in claim 1, wherein said smaller stepping amount region of said accelerator pedal corresponds to a fully closed position of said throttle valve and positions thereof in the vicinity of said fully closed position.

4. An operation control system for an internal combustion engine having an intake system, a throttle valve including a first rotary shaft rotatably arranged in said intake system and a throttle valve body provided on said first rotary shaft for rotation in unison therewith, and an accelerator pedal for adjusting the valve opening of said throttle valve, said operation control system comprising in combination:

mechanically connecting means operatively connecting between said accelerator pedal and said throttle valve, said mechanically connecting means having a second rotary shaft disposed for rotation through an angle directly proportional to a change in the stepping amount of said accelerator pedal, said mechanically connecting means being operable such that an amount of change in the valve opening of said throttle valve relative to a change in the stepping amount of said accelerator pedal is smaller when said accelerator pedal is in a smaller stepping amount region than when said accelerator pedal is in a larger stepping amount region;

a throttle valve opening sensor adapted to generate as actual throttle valve opening an output signal directly proportional in value to a stepping amount of said accelerator pedal, said throttle valve opening sensor being mounted on said second rotary shaft such that said output signal therefrom represents a circumferential position of said second rotary shaft; and control means responsive to said output signal from said throttle valve opening sensor for controlling an operating amount of said operation control system.

5. An operation control system for an internal combustion engine having an intake system, a throttle valve including a first rotary shaft rotatably arranged in said intake system and a throttle valve body provided on said first rotary shaft for rotation in unison therewith, and an accelerator pedal for adjusting the valve opening of said throttle valve, said operation control system comprising in combination:

a throttle valve opening sensor adapted to generate as actual throttle valve opening an output signal directly proportional in value to a stepping amount of said accelerator pedal;

mechanically connecting means operatively connecting between said accelerator pedal and said throttle valve, said mechanically connecting means being operable such that an amount of change in the valve opening of said throttle valve relative to a change in the stepping amount of said accelerator pedal is smaller when said accelerator pedal is in a smaller stepping amount region than when said accelerator pedal is in a larger stepping amount region, said mechanically connecting means including:

a first lever having one end thereof mounted on said first rotary shaft for pivoting in unison therewith, a second rotary shaft extending parallel with said first rotary shaft at a predetermined location, said second rotary shaft being disposed for rotation through an angle directly proportional to a change in the stepping amount of said accelerator pedal, a second lever having one end thereof mounted on said second rotary shaft for pivoting in unison therewith, said second lever having an effective length larger than that of said first lever, a rod having opposite ends thereof pivoted to the other ends of said first and second levers, and operating means responsive to stepping-on of said accelerator pedal for causing said second lever to pivot about said second rotary shaft;

said throttle valve body, said first and second rotary shafts, and said first and second levers being disposed such that an angle through which said second lever is to be pivotally displaced about said second rotary shaft so that said first lever is pivotally displaced about said first rotary shaft through a certain angle becomes smaller as said accelerator pedal is shifted from said smaller stepping amount region to said larger stepping amount region; and control means responsive to said output signal from said throttle valve opening sensor for controlling an operating amount of said operation control system.

6. An operation control system for an internal combustion engine having an intake system, a throttle valve including a first rotary shaft rotatably arranged in said intake system and a throttle valve body provided on said first rotary shaft for rotation in unison therewith, and an accelerator pedal for adjusting the valve opening of said throttle valve, said operation control system comprising in combination:

a throttle valve opening sensor adapted to generate as actual throttle valve opening an output signal directly proportional in value to a stepping amount of said accelerator pedal;

mechanically connecting means operatively connecting between said accelerator pedal and said throttle valve, said mechanically connecting means being operable such that an amount of change in the valve opening of said throttle valve relative to a change in the stepping amount of said accelerator pedal is smaller when said accelerator pedal is in a smaller stepping amount region than when said accelerator pedal is in a larger stepping amount region;

said mechanically connecting means including:

a first lever having one end thereof mounted on said first rotary shaft for pivoting in unison therewith, a second rotary shaft extending parallel with said first rotary shaft at a predetermined location, said second rotary shaft being disposed for rotation through an angle directly proportional to a change in the stepping amount of said accelerator pedal, a second lever having one end thereof mounted on said second rotary shaft for pivoting in unison therewith, said second lever having an effective length larger than that of said first lever, a roller mounted on the other end of said second lever for urging contact with one lateral side surface of said first lever, means permanently imparting a force to said first lever into urging contact with said roller, and operating means responsive to stepping-on of said accelerator pedal for causing said second lever to pivot about said second rotary shaft;

said throttle valve body, said first and second rotary shafts, and said first and second levers being disposed such that an angle through which said second lever is to be pivotally displaced about said second rotary shaft so that said first lever is pivotally displaced about said first rotary shaft through a certain angle becomes smaller as said accelerator pedal is shifted from said smaller stepping amount region to said larger stepping amount region; and control means responsive to said output signal from said throttle valve opening sensor for controlling an operating amount of said operation control system.

7. An operation control system for an internal combustion engine having an intake system, a throttle valve arranged in said intake system, and an accelerator pedal for adjusting the valve opening of said throttle valve, said operation control system comprising:

a throttle valve opening sensor adapted to generate as actual throttle valve opening an output signal directly proportional in value to an amount of depression of said accelerator pedal;

nonlinear connecting means for operatively coupling said accelerator pedal to said throttle valve to move said throttle valve in response to depression of said accelerator pedal, said nonlinear connecting means being operative in a range of movement of said accelerator pedal excluding the position of the pedal which corresponds to a fully closed position of the throttle valve the amount of movement of said throttle valve not being proportional to the amount of depression of said accelerator pedal within said range, said range having a small stepping amount region adjacent the accelerator pedal position corresponding to the fully closed position of the throttle valve, and a larger stepping amount region, the amount of change in the valve opening of said throttle valve relative to a change in the amount of depression of said accelerator pedal being smaller when said accelerator pedal is in said small stepping amount region than when said accelerator pedal is in said larger stepping amount region; and control means responsive to said output signal from said throttle valve opening sensor for controlling a quantity determining parameter of said operation control system.

* * * * *